US006008829A

United States Patent [19]

Wakamiya et al.

[11] Patent Number: 6,008,829

[45] Date of Patent: Dec. 28, 1999

[54] CONTROL APPARATUS FOR FIXING UNIT HAVING PLURAL HEATERS

[75] Inventors: Hidehiro Wakamiya, Susono; Kaoru Sato, Ashigara; Tatsuto Tachibana, Numazu, all of Japan

[73] Assignee: Canon Kabushiki Kaisha, Tokyo, Japan

[21] Appl. No.: 08/865,356

[22] Filed: May 29, 1997

[30] Foreign Application Priority Data

Jun. 4, 1996 [JP] Japan ..... 8-162476

[51] Int. Cl.[6] ..... B41J 2/385; G03G 15/20; H05B 1/00

[52] U.S. Cl. ..... 347/156; 347/102; 347/212; 399/69; 399/330; 399/335; 219/216; 219/492

[58] Field of Search ..... 347/133, 262, 347/264, 212, 102, 155, 156; 346/25; 219/216, 492; 399/33, 69, 70, 320, 330, 400, 335; 358/300; 101/DIG. 37; 432/60

[56] References Cited

U.S. PATENT DOCUMENTS

| | | | |
|---|---|---|---|
| 5,220,389 | 6/1993 | Kishimoto et al. | 399/69 |
| 5,334,817 | 8/1994 | Nakamori et al. | 219/492 |
| 5,508,797 | 4/1996 | Tonai et al. | 399/39 |
| 5,512,993 | 4/1996 | Endo et al. | 399/33 |
| 5,671,462 | 9/1997 | Toyohara et al. | 399/335 |
| 5,819,134 | 10/1998 | Sato et al. . | |

FOREIGN PATENT DOCUMENTS

| | | |
|---|---|---|
| 0 693 716 | 1/1996 | European Pat. Off. . |
| 0 751 442 | 1/1997 | European Pat. Off. . |

OTHER PUBLICATIONS

Patent Abstracts of Japan, vol. 012, No. 100 (P–683), Apr. 2, 1988, & JP 62–232674 (Sharp Corp.), Oct. 13, 1987.

Patent Abstracts of Japan, vol. 013, No. 314 (P–899), Jul. 18, 1989, & JP 01–084271 (Minolta Camera Co. Ltd.), Mar. 29, 1989.

*Primary Examiner*—N. Le
*Assistant Examiner*—L. Anderson
*Attorney, Agent, or Firm*—Fitzpatrick, Cella, Harper & Scinto

[57] ABSTRACT

A heater of a fixing unit of a recording apparatus is constructed by a main heater and a sub heater. When the apparatus is in a standby mode, each heater is first turned off. When a temperature of the fixing unit is equal to or lower than a heating start temperature of the sub heater, the sub heater is turned on. After that, when the temperature of the fixing unit reaches a heating stop temperature of the sub heater, the sub heater is turned off. After that, when the temperature of the fixing unit is equal to or lower than the heating start temperature, the main heater is turned on. After that, when it reaches the heating stop temperature of the main heater, the main heater is turned off. The above operations are repeated. In the recording mode, the order of the on/off periods in a control unit time of each heater is switched every period and the temperature control is executed, thereby reducing a flickering.

26 Claims, 17 Drawing Sheets

CONTROL APPARATUS FOR FIXING UNIT HAVING PLURAL HEATERS

BACKGROUND OF THE INVENTION

1. Field of the Invention

The invention relates to a heating control of a fixing unit of an image recording apparatus.

2. Related Background Art

Hitherto, in a fixing unit which is installed in a recording apparatus of a laser beam printer or the like, a halogen heater or ceramic heater is used as a heat source, a temperature of a heat generated from the heat source is detected by a temperature sensor provided in the fixing unit, and a fixing temperature is controlled on the basis of temperature information. Further, in recent years, a fixing unit having two or more halogen heaters in order to reduce a warming-up time of the fixing unit has also been proposed.

In the recording apparatus equipped with such a kind of fixing unit, in what is called a standby mode other than the time of the recording operation, when a recording operation instruction is received, the fixing unit is controlled so as to be maintained at a predetermined temperature in order to promptly fix toner onto a transfer material. In a printing mode, when a detection temperature of a fixing roller detected by the temperature sensor is higher than a predetermined temperature, the heat source is turned off and when the detection temperature is lower than the predetermined temperature, the heat source is turned on, thereby performing a temperature control and keeping the fixing unit at a predetermined temperature.

The above conventional apparatus, however, has the following problems. That is, (1) When the halogen heater is used as a heat source and an illuminating equipment to which a power source is supplied from the same-AC outlet as that of the recording apparatus exists, there is a problem such that an adverse influence is exerted on the illuminating equipment at the start of the heating of the fixing unit in dependence on an impedance of a power source line, so that the illumination momentarily becomes dark.

That is, in the standby mode after completion of a warming-up process of the fixing unit or during the printing operation, for example, when a plurality of halogen heaters are concurrently turned on or the on/off operations of the halogen heater are frequently repeated, there is a problem such that a fluorescent lamp to which a power source is supplied from the same AC outlet flickers or the like, in other words, there occurs a flicker phenomenon due to a rash current generated at the start of the heating of the heat source.

(2) In a fixing unit having a plurality of heat sources, since the temperature control is performed by using only one of a plurality of heat sources in the standby mode in order to suppress the maximum electric power consumption, there is a problem such that it is difficult to realize a long life of the fixing unit. Particularly, there is also a recording apparatus such that almost of the mode during the power-on is the standby mode. In such a case, since the life of the fixing unit is fairly short, there is a problem such that the number of times of replacement of the fixing unit increases and the use efficient is bad.

(3) Since a plurality of heat sources are simply turned on and off on the basis of the predetermined temperature as a reference during the printing operation, particularly, in a high speed printer using a heat source of a high power, since a recording paper absorbs a large quantity of heat from the fixing unit, a temperature rising speed at the time of turn-on of the heat source and a temperature decreasing speed at the time of turn-off of the heat source are large. There is, consequently, a problem such that a temperature change of the fixing unit Is also large and a high accurate temperature control cannot be performed.

SUMMARY OF THE INVENTION

It is an object of the invention to provide a fixing unit control apparatus and a control method of a fixing unit which can solve the foregoing drawbacks.

Another object of the invention is to provide a fixing unit control apparatus and a fixing unit control method in which a temperature control can be performed at a high precision without exerting an adverse influence on other equipment such as an illuminating equipment and the like and a durability can be improved.

Still another object of the invention is to provide a fixing unit control apparatus and a fixing unit control method in which a plurality of heaters in one fixing unit are efficiently used.

The above and other objects and features of the present invention will become apparent from the following detailed description and the appended claims with reference to the accompanying drawings.

DETAILED DESCRIPTION OF THE PREFERRED EMBODIMENTS

An embodiment of the invention will now be described hereinbelow with reference to the drawings.

Figure 1:
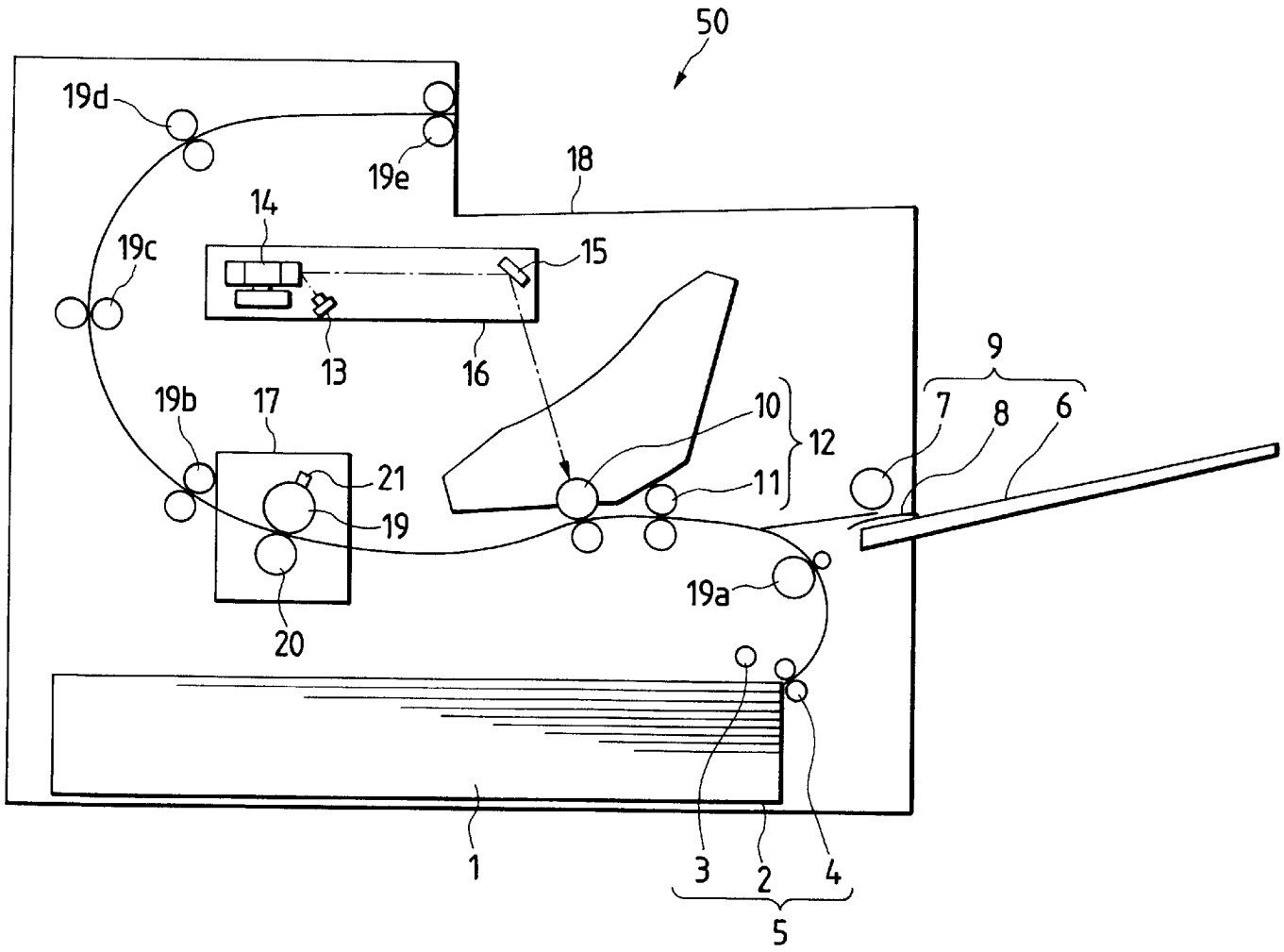
FIG. 1 is an internal structural diagram schematically showing a laser beam printer to which a fixing unit control apparatus according to the invention is applied.

FIG. 1 is an internal structural diagram of a laser beam printer as a recording apparatus to which a fixing unit control apparatus according to the invention is installed. A laser beam printer 50 is made up of, as main units: a paper feed unit 5 comprising a paper feed cassette 2 in which standard papers 1 of a predetermined size are enclosed, a pickup roller 3 to pick up the standard papers 1, and a feed roller 4 to feed the standard paper picked up by the pickup roller 3; a multipurpose tray (hereinafter, referred to as an MPT) unit 9 comprising an MPT main body 6 from which desired non-standard papers or standard papers can be manually fed, an MPT feed roller 7 to convey the paper fed from the MPT main body 6, and an MPT lifter 8 for depressing the paper onto the MPT roller 7; an image forming unit 12 comprising an electrostatic drum 10 for transferring a developing agent onto the recording paper and forming an image and a resist roller 11; an optical system 16 which comprises a semiconductor laser 13, a polygon mirror 14, a reflecting mirror 15, and the like and supplies a laser beam onto the electrostatic drum 10; a fixing unit 17 for fixing the image formed on the recording paper by the image forming unit 12; a paper ejecting unit 18 for ejecting the recording paper on which the image was fixed by the fixing unit 7; and conveying rollers 19*a* to 9*e* arranged on a conveying path of the recording paper.

In the laser beam printer 50 constructed as mentioned above, the paper 1 fed from the paper feed cassette 2 is conveyed toward the resist roller 11 through the conveying rollers 19*a* or the paper from the MPT unit 9 is conveyed toward the resist roller 11. A latent image is formed by a laser beam emitted from the optical system 16 and is developed by the developing agent. The developed image is transferred onto the paper by the image forming unit 12 and is fixed by the fixing unit 17. The recording paper is ejected to the paper ejecting unit 18 through the conveying rollers 9*b* to 19*e*.

Figure 2:
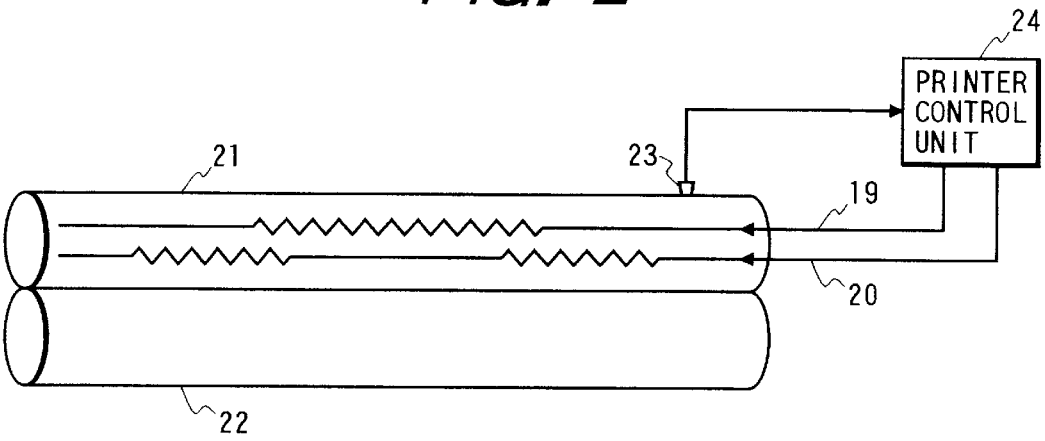
FIG. 2 is a structural diagram showing the details of a fixing unit.

As specifically shown in FIG. 2, the fixing unit 17 comprises: a fixing roller 21 having a main heater 19 and a sub heater 20 therein; a pressurizing roller 22 for pressing the recording paper to the fixing roller 21; and a thermistor (temperature detecting unit) 23 for detecting a surface temperature of the fixing roller 21. The thermistor 23, main heater 19, and sub heater 20 are connected to a printer control unit 24, respectively. The main heater 19 and sub heater 20 are controlled by the printer control unit 24 on the basis of an output result of the thermistor 23.

Figure 3A:
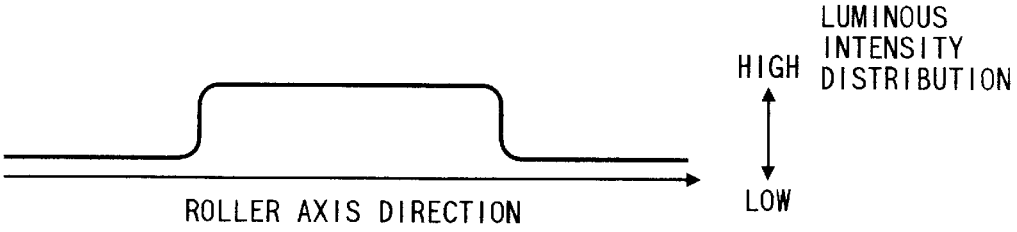
FIGS. 3A and 3B are luminous intensity distribution diagrams of a heater which is used in the invention.
Figure 3B:
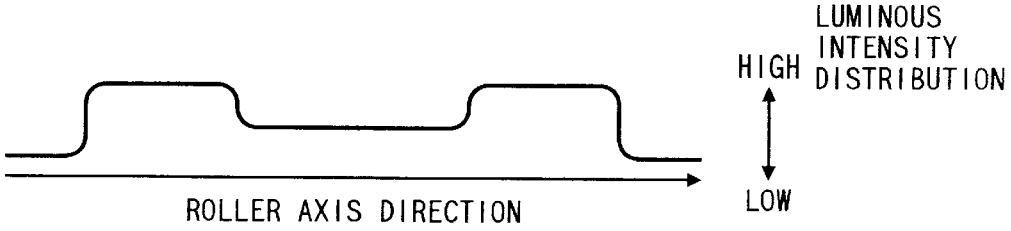

Luminous intensity distributions of the main heater 19 and sub heater 20 are different. As shown in FIG. 3A, the main heater 19 has the luminous intensity distribution at a center portion of the fixing roller 21. The sub heater 20 has the luminous intensity distributions at positions near both end portions of the fixing roller 21. Since the thermistor 23 is arranged so as to be come into contact with the fixing roller 21, it is positioned at a place where the recording paper doesn't pass, namely, a location near the peak of the luminous intensity distribution of the sub heater 20 in the embodiment in order to avoid an influence on the image by a friction or the like of the contact portion.

Figure 4:
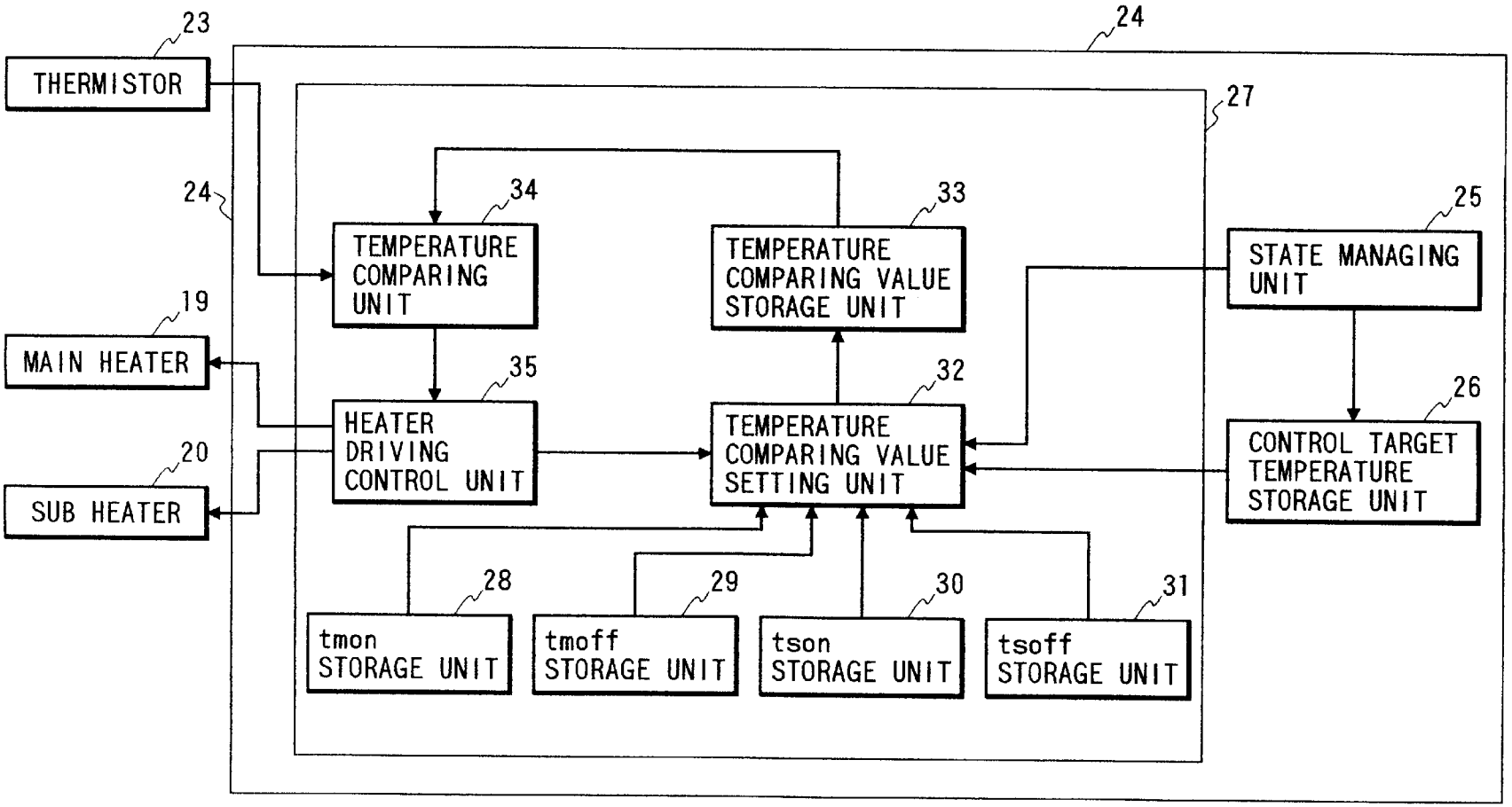
FIG. 4 is a block constructional diagram of the first embodiment of the fixing unit control apparatus according to the invention.

FIG. 4 is a block constructional diagram showing the first embodiment of the printer control unit 24. The printer control unit 24 comprises: a state managing unit 25 for managing each control mode of the laser beam printer 50 such as warming-up mode, standby mode, printing mode, failure mode, etc.; a control target temperature storage unit 26 for storing a control target temperature of the fixing heater (main heater 19 and sub heater 20) which is set by the state managing unit 25; and a fixing heater control unit 27 for controlling a temperature of the fixing roller 21 on the basis of the control mode shown by the state managing unit 25 and the target temperature value which is set by the control target temperature storage unit 26.

Specifically speaking, the fixing heater control unit 27 comprises: a tmon storage unit 28 in which a heating start temperature tmon of the main heater 19 has been stored; a tmoff storage unit 29 in which a heating stop temperature tmoff of the main heater 19 has been stored; a tson storage unit 30 in which a heating start temperature tson of the sub heater 20 has been stored; a tsoff storage unit 31 in which a heating stop temperature tsoff of the sub heater 20 has been stored; a temperature comparing value setting unit 32 for setting a temperature comparing value on the basis of output results of the temperature storage units 28 to 31, state managing unit 25, control target temperature storage unit 26, and further, on/off information of the main heater 19 and sub heater 20 from a heater driving unit, which will be explained hereinlater; a temperature comparing value storage unit 33 for storing a setting result by the temperature comparing value setting unit 32; a temperature comparing unit 34 for comparing the temperature stored in the temperature comparing value storage unit 33 and the temperature detected by the thermistor 23; and a heater driving control unit 35 for alternately turning on and off the main heater 19 and sub heater 20 on the basis of a comparison result of the temperature comparing means 34.

The heating start temperature tmon of the main heater 19 and the heating start temperature tson of the sub heater 20 are set to temperatures at which their temperatures can reach a predetermined printing temperature within a predetermined time after the start of the printing. The heating stop temperature tmoff of the main heater 19 and the heating stop temperature tsoff of the sub heater 20 are set to a predetermined temperature at which a breakage or the like of the fixing roller 21 doesn't occur and the number of driving times of the main heater 19 and sub heater 20 is reduced as small as possible. From the positional relations between the luminous intensity distributions of the main heater 19 and sub heater 20 and the thermistor 23, the heating start temperature tmon of the main heater 19 is set to a temperature value higher than the heating start temperature tson of the sub heater 20 and the heating stop temperature tmoff of the main heater 19 is set to a temperature value lower than the heating stop temperature tsoff of the sub heater 20.

The control operation in the standby mode and printing mode of the fixing heater control unit 27 will now be described.

Figure 5:
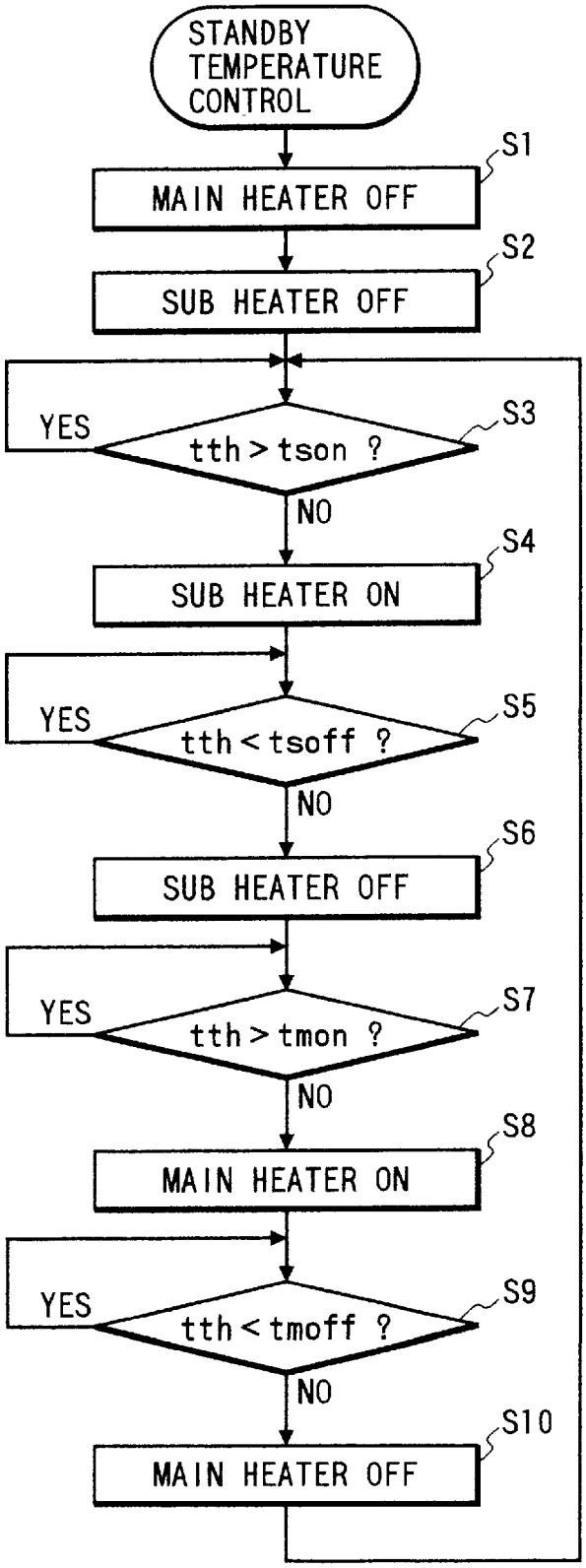
FIG. 5 is a flowchart showing a control procedure for a standby temperature adjustment control in the first embodiment.

FIG. 5 is a flowchart showing a control procedure in the standby mode of the fixing heater control unit 27.

First in step SI, the main heater 19 is turned off. In step S2, the sub heater 20 is turned off. In step S3, a check is made to see if a detection temperature tth of the thermistor 23 is higher than the heating start temperature tson of the sub heater 20. If YES, the apparatus waits until the detection temperature tth is equal to or lower than the heating start temperature tson of the sub heater 20. In step S3, when the detection temperature tth is equal to or lower than the heating start temperature tson of the sub heater 20, the sub heater 20 is turned on in step S4. In step S5, a check is made to see if the detection temperature tth is lower than the heating stop temperature tsoff of the sub heater 20. If YES, the apparatus waits until the detection temperature tth reaches the heating stop temperature tsoff. When the detection temperature tth reaches the heating stop temperature tsoff of the sub heater 20, step S7 follows and the sub heater 20 is turned off. In step S7, a check is made to see if the detection temperature tth is higher than the heating start temperature tmon of the main heater 19. If YES, the apparatus waits until the detection temperature tth is equal to or lower than the heating start temperature tmon of the main heater 19. When tth is equal to or lower than the heating start temperature tmon of the main heater 19, step S8 follows and the main heater 19 is turned on. In step S9, a check is made to see if the detection temperature tth is lower than the heating stop temperature tmoff of the main heater 19. If YES, the apparatus waits until the detection temperature tth reaches the heating stop temperature tmoff of the main heater 19. When the detection temperature tth reaches the heating stop temperature tmoff of the main heater 19, step S10 follows and the main heater 19 is turned off and the processing routine is returned to step S3. The above processes are repeated.

As mentioned above, the number of driving times (on/off times) of the main heater 19 and sub heater 20 can be minimized by performing a temperature control of the fixing roller 21 in the standby mode.

Figure 6:
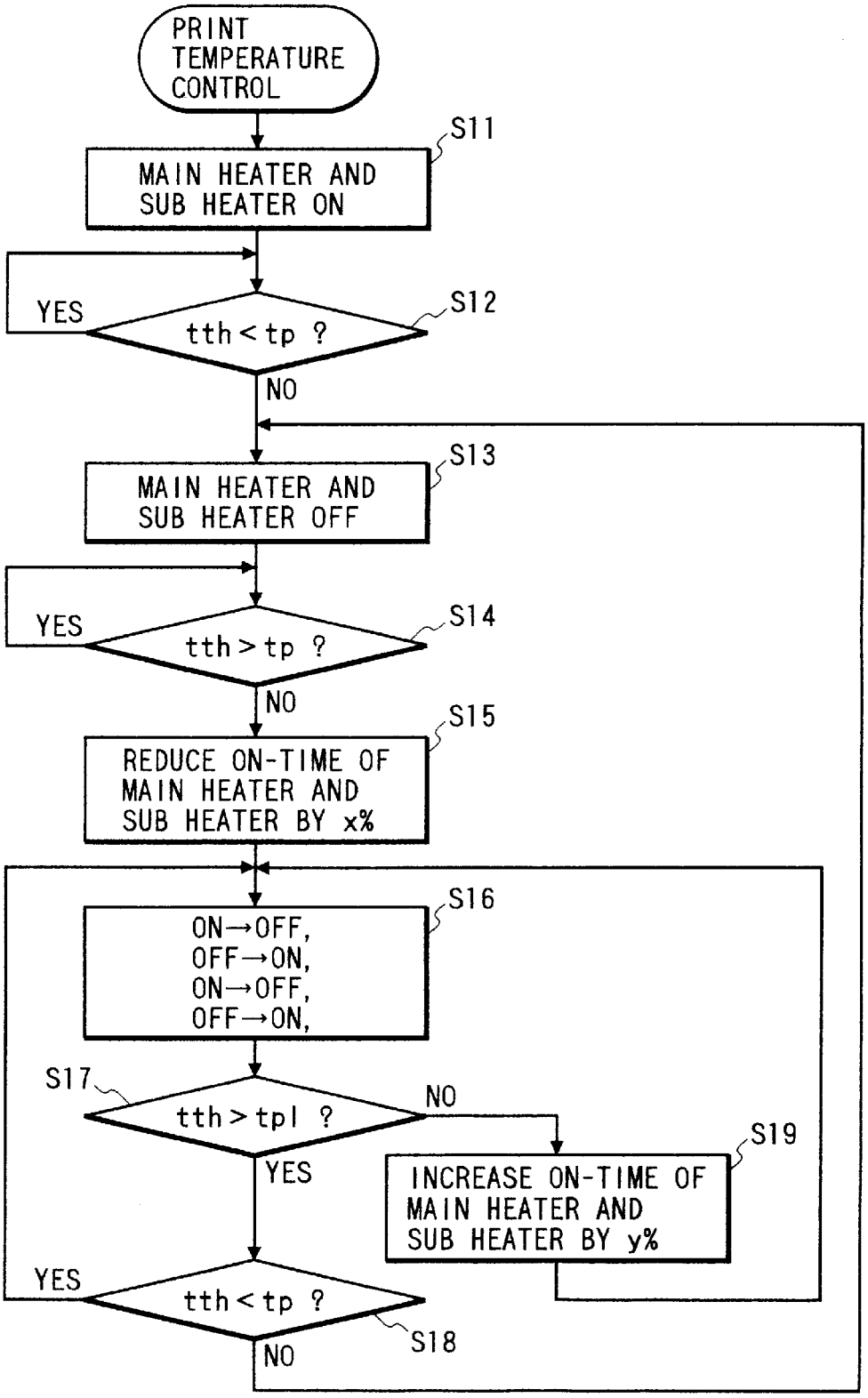
FIG. 6 is a flowchart showing a control procedure for a print temperature adjustment control in the first embodiment.

FIG. 6 is a flowchart showing a control procedure in the printing mode of the fixing heater control unit 27.

First in step S11, the main heater 19 and sub heater 20 are turned on. In step S12, a check is made to see if the detection temperature tth of the thermistor 23 is lower than an adjustment temperature tp stored in the control target temperature storage unit 22. If YES, the apparatus waits until the detection temperature tth reaches the adjustment temperature tp. When the detection temperature tth reaches the adjustment temperature tp, the main heater 19 and sub heater 20 are turned off in step S13. Step S14 follows and a check is made to see if the detection temperature tth is higher than the adjustment temperature tp. If YES, the apparatus waits until the detection temperature tth is equal to or lower than the adjustment temperature tp. When the detection temperature tth is equal to or lower than the adjustment temperature tp, step S15 follows, an on-time in a control one unit time U of the main heater 19 and sub heater 20 is decreased by x % (for example 10%) and the main heater 19 and sub heater 20 are again turned on. That is, in the embodiment, the control one unit time U (for example, 500 msec) is set to one period and the on-time of the main heater 19 and sub heater 20 in the control one unit time U is controlled, thereby performing a temperature control in the printing mode.

In step S16, the on/off controls of the main heater 19 and sub heater 20 are executed so that the order of the on/off operations of the heaters in the control one unit time U are set to (on→off), (off→on), (on→off), . . . every period. In step S17, a check is made to see if the detection temperature tth is higher than a fixing lower limit temperature tp1 which has been preset in the control target storage unit. If YES, step S18 follows and a check is made to see if the detection temperature tth is lower than the adjustment temperature tp. If YES, the processing routine is returned to step S16 and the on/off controls of the main heater 19 and sub heater 20 are again repeated. If NO in step S18, the processes in steps S13 and S14 are again repeated. In step S15, the on-time in the control one unit time U of the main heater 19 and sub heater 20 is reduced by x % and the main heater 19 and sub heater 20 are again turned on. A reduction ratio x in this case is set to be larger than a previous reduction ratio x and the on-time per control one unit time U of the main heater 19 and sub heater 20 is reduced, thereby performing the temperature control so that the detection temperature tth is equal to or less than the adjustment temperature tp. That is, when the previous reduction ratio x is equal to 10%, the present reduction ratio x is set to, for example, 15%, thereby decreasing the on-time per control one unit time U of the main heater 19 and sub heater 20. If NO in step S17, namely, when the detection temperature tth is equal to or'lower than the fixing lower limit temperature tp1, step S19 follows. The on-time in the control one unit time U is increased by y % (for example, 5%) and the main heater 19 and sub heater 20 are turned on. The processing routine is returned to step S16.

Figure 7:
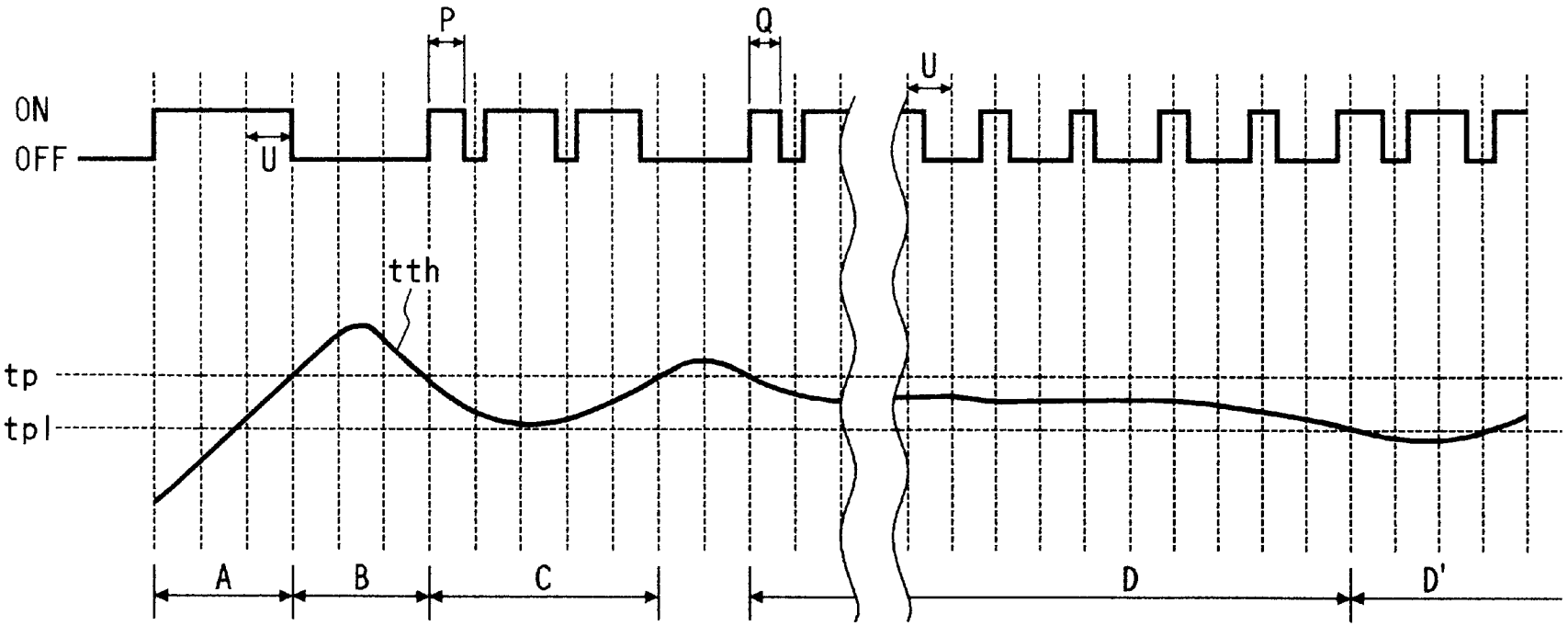
FIG. 7 is a time chart showing a temperature adjustment control upon printing in the first embodiment.

FIG. 7 is a time chart showing temperature changes of the main heater 19 and sub heater 20 in the printing mode.

When the control mode is shifted from the standby mode to the printing mode and the printing operation is started, the main heater 19 and sub heater 20 are continuously turned on for a whole region of the control one unit time U (for instance, 500 msec) until the detection temperature tth exceeds the adjustment temperature tp (A region). The main heater 19 and sub heater 20 are turned off at a time point when the detection temperature tth exceeds the adjustment temperature tp and the off state is continued until the detection temperature tth is again equal to or lower than the adjustment temperature tp (B region). When the detection temperature tth is equal to or lower than the adjustment temperature tp, the on-time of the control one unit time U of the main heater 19 and sub heater 20 is reduced by x % (for example, 10%) and the main heater 19 and sub heater 20 are turned on. That is, the main heater 19 and sub heater 20 are turned on for only a time width shown at P in the diagram in the control one unit time U. In this instance, the on/off controls of the main heater 19 and sub heater 20 are performed in a manner such that the order of the on/off operations of the heaters in the control one unit time U is set to (on→off), (off→on), (on→off), . . . every period (C region). In such a C region, therefore, as compared with the case of continuing the on-state of the main heater 19 and sub heater 20, an electric power to be supplied is reduced by 10% and a temperature increase of the fixing roller 21 is also small.

After that, when the detection temperature tth again exceeds the adjustment temperature tp, it has been found that the detection temperature tth exceeds the adjustment temperature tp in case of the foregoing reduction ratio x (for example, 10%). Therefore, in order to set the detection temperature tth to be equal to or lower than the adjustment temperature tp, the reduction ratio x is raised to a value larger than the previous reduction ratio, namely, it is set to, e.g., 15% and as shown at Q in the diagram, the on-time in the control one unit time U is further reduced and the on/off controls of the main heater 19 and sub heater 20 mentioned above are again performed (D region).

By repeating the above operation, the temperature of the fixing roller 21 continuously decreases. That is, as shown in the D region, the temperature of the fixing roller 21 continuously decreases for a certain period (for example, ten periods). When the detection temperature tth equal to or lower than the fixing lower limit temperature tp1, the on-time in the control one unit time U is increased by y % (for example, 5%), thereby raising the temperature of the fixing roller 21 (D' region).

According to the embodiment as mentioned above, in the standby mode, the main heater 19 and sub heater 20 are alternately turned on and, in the printing mode, the control one unit time U is set to one period and the on-time of the main heater 19 and sub heater 20 in the control one unit time U is controlled, so that an adverse influence on the other equipment such as an illuminating equipment and the like can be eliminated as small as possible.

Particularly, in the control in the standby mode, the heating start temperature is set to a value as low as possible and the heater heating stop temperature is set to a value as high as possible for the control target temperature value, so that the number of times of the on/off operations of each heater can be minimized.

Since the heating start temperature and heating stop temperature of the heaters are individually set with respect to each of the main heater 19 and sub heater 20, a difference between the actual heating amount and the detection temperature value due to a difference between the luminous intensity distributions of the main heater 19 and sub heater 20 and the layout position of the thermistor 23 can be absorbed.

Figure 8:
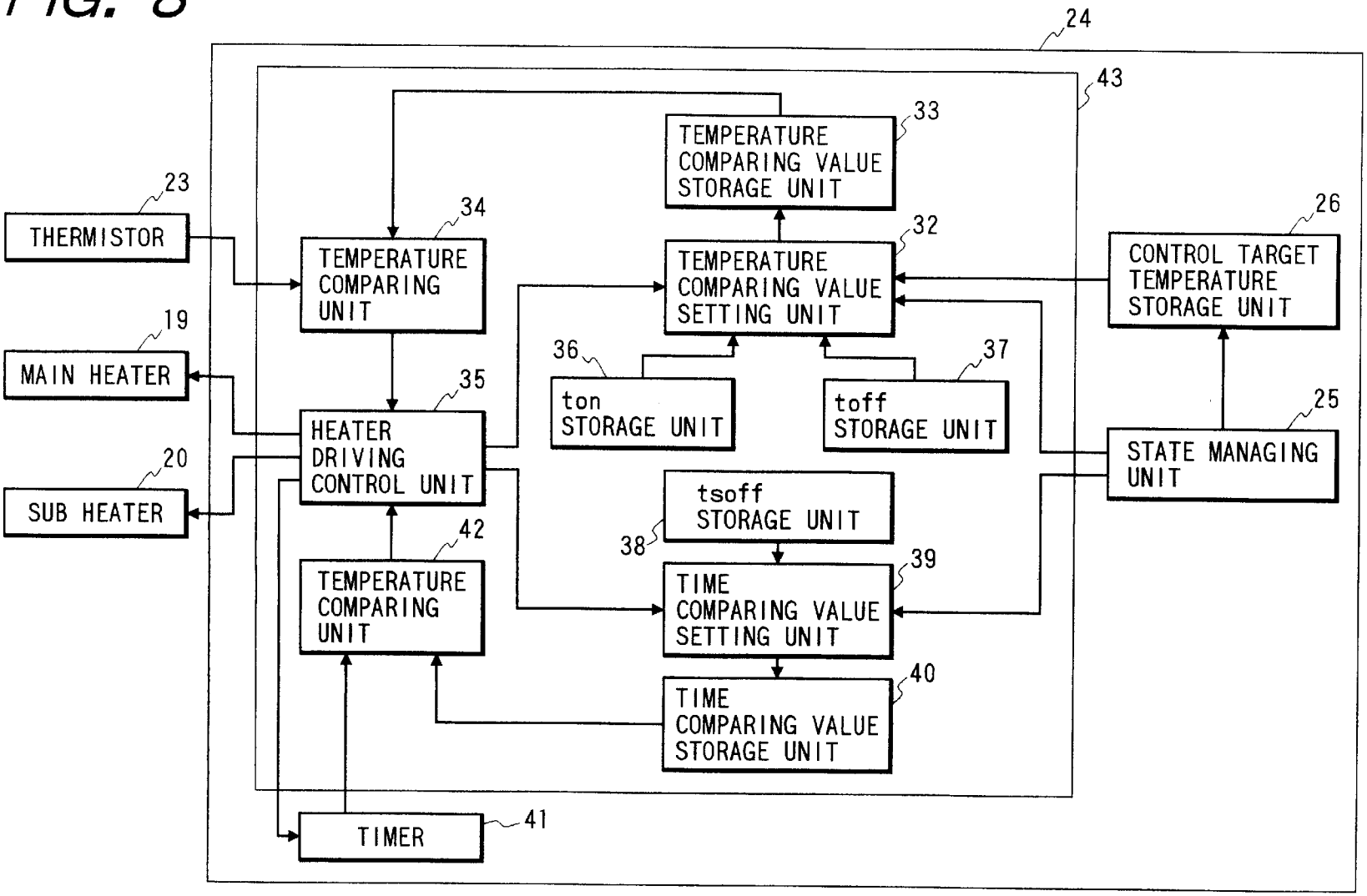
FIG. 8 is a block constructional diagram showing the second embodiment of the invention.

FIG. 8 is a block constructional diagram showing the second embodiment of the invention. In the second embodiment, in place of the temperature storage units 28 to 31 in which the heating start temperatures tmon and tson and the heating stop temperatures tmoff and tsoff of the main heater 19 and sub heater 20 have been stored in the first embodiment, there are further provided: a ton storage unit 36 and a toff storage unit 37 in which a common heater heating start temperature ton and a common heater heating stop temperature toff of the main heater 19 and sub heater 20 have been stored; a Tsoff storage unit 38 to store a sub heater heating time Tsoff indicative of the on-time of the sub heater 20; a time comparing value setting unit 39 for setting the sub heater heating time Tsoff as a time comparing value in the standby mode; a time comparing value storage unit 40 for storing the time comparing value set by the time comparing value setting unit 39; a timer 41 for counting a time in accordance with an instruction from the heater driving control unit 35; and a time comparing unit 42 for comparing the count value of the timer 41 with the storage value stored in the time comparing value storage unit 40 and notifying the heater driving control unit 26 of a comparison result.

In the foregoing first embodiment, two heaters are alternately used for a range from the heater heating start temperature to the heating stop temperature in the standby temperature control. According to the second embodiment, however, after the fixing unit was heated by one of the heaters from the heater heating start temperature, it is heated by the other heater up to the heater heating stop temperature, thereby averaging the heating times of the main heater 19 and sub heater 20 while further uniforming the surface temperature of the fixing roller 21.

Figure 9:
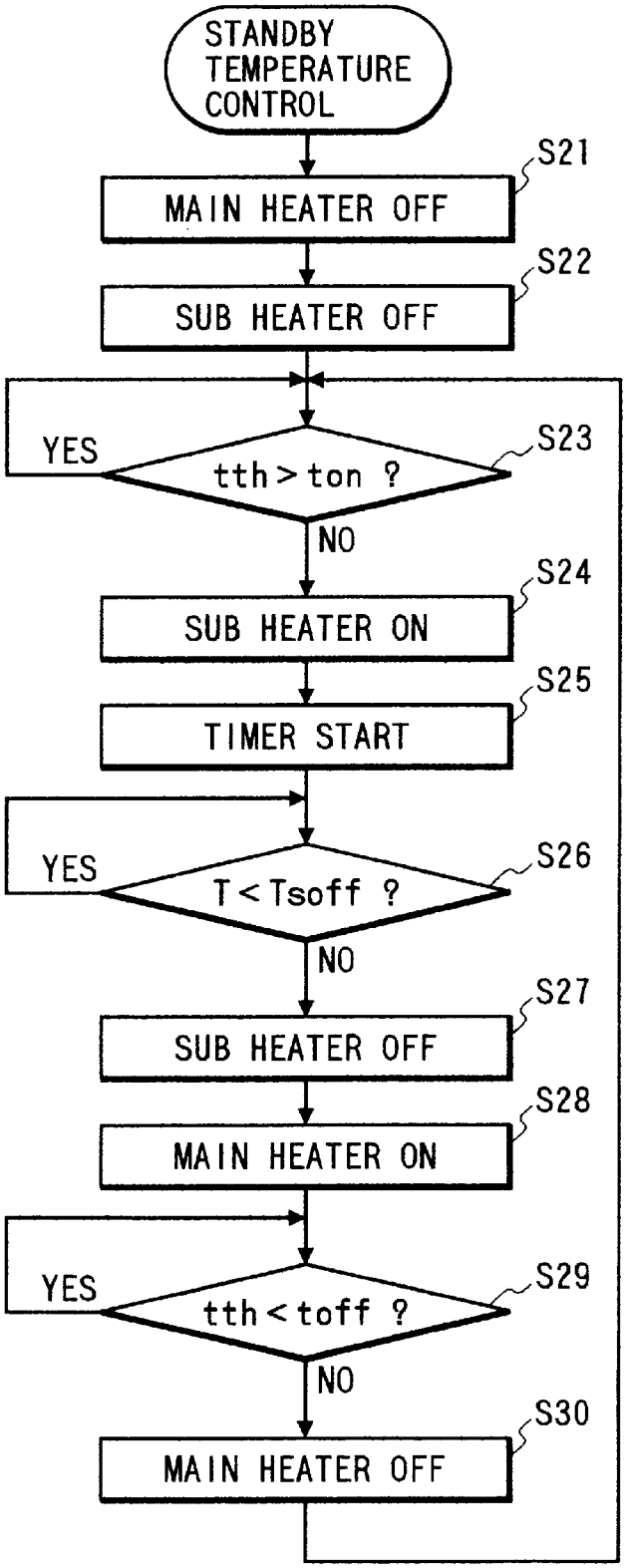
FIG. 9 is a flowchart showing a control procedure for a standby temperature adjustment control according to the second embodiment.

FIG. 9 is a flowchart showing a control procedure in the standby mode of a fixing heater control unit 43 according to the second embodiment.

First in step S21, the main heater 19 is turned off. In step S22, the sub heater 20 is turned off. In step S23, a check is made to see if the detection temperature tth of the thermistor 23 is higher than the heater heating start temperature ton. If YES, the apparatus waits until the detection temperature tth is equal to or lower than the heater heating start temperature ton. When the detection temperature tth is equal to or lower than the heater heating start temperature ton in step S23, the sub heater 20 is turned on in step S24. In step S25, the timer 41 is started, thereby starting the counting operation. In step S26, a check is made to see if a count value T of the timer 41 is smaller than the sub heater heating time Tsoff stored in the Tsoff storage unit 38. If YES, the apparatus waits until the count value T reaches the sub heater heating time Tsoff. When the count value T reaches the sub heater heating time Tsoff, step S27 follows and the sub heater 20 is turned off. In step S28, the main heater is turned on. In step S29, a check is made to see if the detection temperature tth is lower than the heater heating stop temperature toff stored in the toff storage unit 37. If YES, the apparatus waits until the detection temperature tth reaches the heater heating stop temperature toff. When the detection temperature tth reaches the heater heating stop temperature toff, step S30 follows and the main heater 19 is turned off. The processing routine is returned to step S23 and the above processes are repeated.

As mentioned above, the fixing roller 21 is heated by only one sub heater 20 at the heater heating start temperature. After the elapse of a predetermined time, the heater to heat is switched from the sub heater 20 to the main heater 19 and the fixing roller 21 is heated by the main heater 19 until the temperature reaches the heater heating stop temperature. Thus, the temperature distribution on the surface of the fixing roller can be uniformed.

In the second embodiment, in the standby mode, the heating time of the sub heater 20 is fixed and the heating times of the main heater 19 and sub heater 20 are switched. However, as a first modification of the second embodiment, it is also preferable to adjust so as to almost equalize the heating times of the main heater 19 and sub heater 20 by measuring the heating time of the main heater 19 and adjusting the switching timing.

That is, in FIG. 8, it is also possible to construct in a manner such that the heater driving control unit 35 starts the timer 41 at both of the start of the turn-on of the sub heater and the start of the turn-on of the main heater 19, the time comparing value setting means 39 compares the heating time by the sub heater 20 and the heating time by the main heater 19, and the set value of the time comparing value is adjusted so as to almost equalize both of the heating times.

Figure 10:
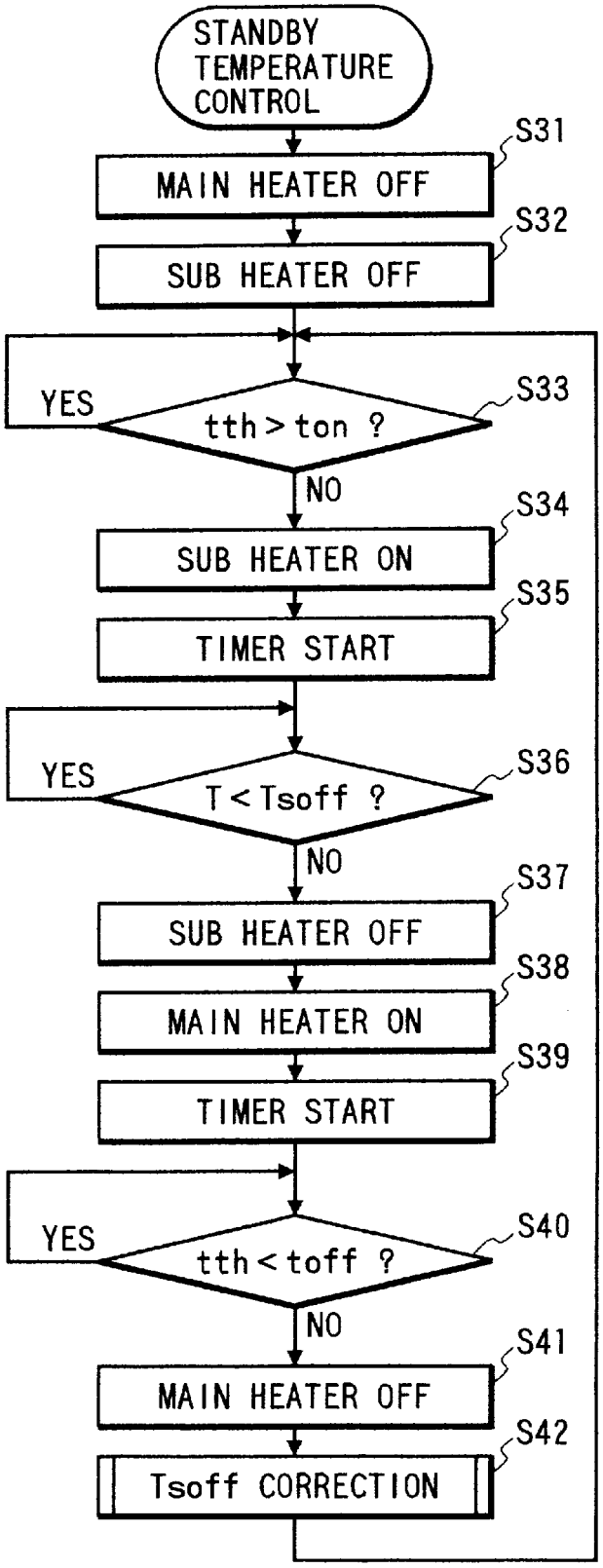
FIG. 10 is a flowchart showing the first modification of the second embodiment.

FIG. 10 is a flowchart showing a control procedure in the standby mode of the fixing heater control unit 43 according to the first modification.

In steps S31 to S37, processes similar to those in steps S21 to S27 in the second embodiment are executed. In step S38, the main heater 19 is turned on. The timer 41 is started by the turn-on of the main heater 19, thereby starting the counting operation. In step S40, a check is made to see if the detection temperature tth is lower than the heater heating stop temperature toff stored in the toff storage unit 37. If YES, the apparatus waits until the detection temperature tth reaches the heater heating stop temperature toff. When the detection temperature tth reaches the heater heating stop temperature toff, step S30 follows and the main heater 19 is turned off. In step S42, the sub heater heating time Tsoff is corrected on the basis of the following equation (1). The processing routine is returned to step S33.

$$\mathrm{Tsoff}(n+1)=\{\mathrm{Tsoff}(n)+\mathrm{T}\}/2 \quad (1)$$

where, Tsoff(n): previous sub heater heating time

Tsoff(n+1): updated present sub heater heating time

Figure 11:
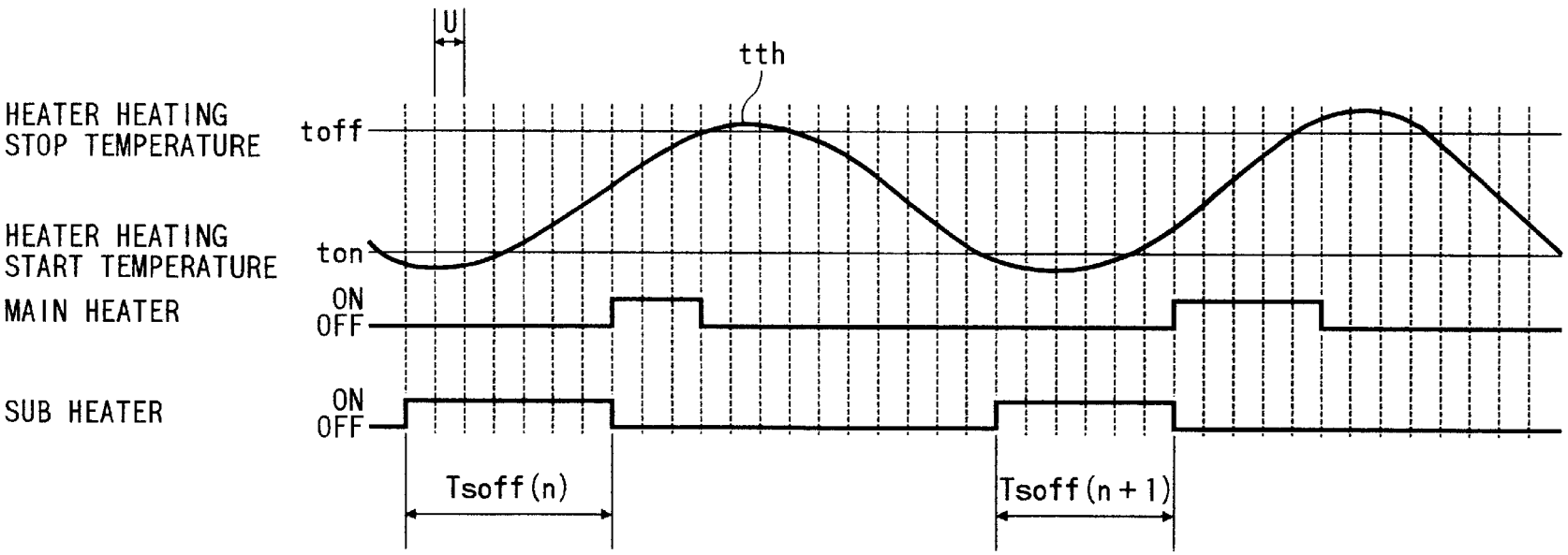
FIG. 11 is a time chart of the first modification of the second embodiment.

FIG. 11 is a time chart showing the temperature control in the standby mode in the first modification.

When the detection temperature tth of the thermistor 23 reaches the heater heating start temperature ton, the sub heater 20 is turned on for only the sub heater heating time Tsoff stored in the Tsoff storage unit 37. After the elapse of the sub heater heating time Tsoff, the sub heater 20 is turned off and the main heater 19 is turned on. When the detection temperature tth reaches the heater heating stop temperature toff, the main heater 19 is turned off and the sub heater heating time Tsoff is corrected in accordance with the equation (1). As for the on-time of the sub heater 20 at the next time, the temperature control of the fixing roller 21 is performed by using the updated sub heater heating time Tsoff.

According to the first modification, since the Tsoff value which was set at the previous time is corrected on the basis of the subsequent heating time of the main heater 19, at the time of the next heating, the heating time of the main heater 19 and the heating time of the sub heater 20 can be made approach each other. The heating times of the main heater 19 and sub heater 20 can be uniformed. An increase in use frequency of either one of the heaters can be avoided and the reduction of the life of the fixing unit can be prevented.

According to the first modification, the driving switching timing Tsoff between the sub heater 20 and main heater 19 is determined by the equation (1). As a second modification, however, the heating time of the main heater 19 and that of the sub heater 20 are compared and the sub heater heating time Tsoff can be increased or decreased by every predetermined time on the basis of a comparison result.

Figure 12:
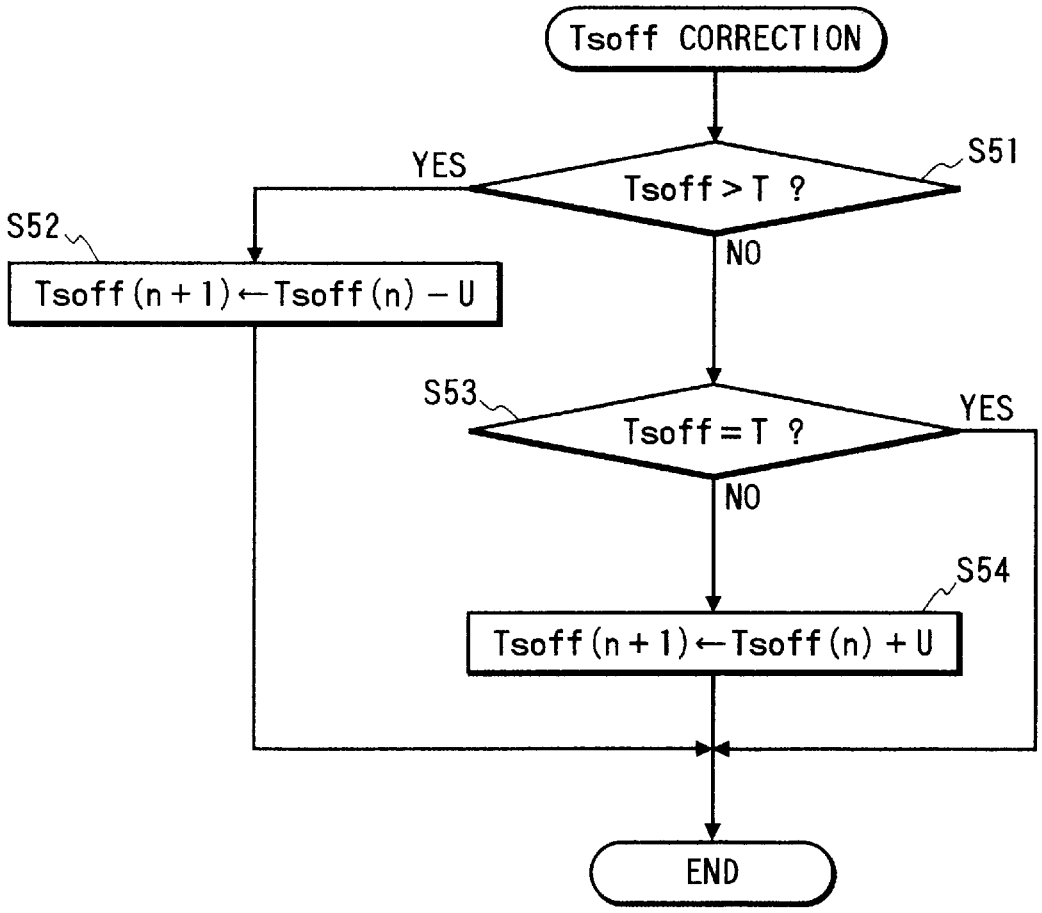
FIG. 12 is a flowchart for a Toff correction showing the second modification of the second embodiment.

FIG. 12 is a flowchart showing a control procedure for a Toff correction showing the second modification of the second embodiment.

In step S51, a check is made to see if the sub heater heating time Tsoff is larger than the count value T of the timer 41, namely, the heating time of the main heater 19. If YES, step S52 follows and the sub heater heating time Tsoff is decreased by only the control one unit time U. If NO in step S51, a check is made to see if the sub heater heating time Tsoff is equal to the count value T, namely, the heating time of the main heater 19. If YES, the processing routine is finished as it is. If No, namely, when the sub heater heating time Tsoff is smaller than the count value T (heating time of the main heater 19), the sub heater heating time Tsoff is increased by only the control one unit time U. Thus, the heating time of the main heater 19 and that of the sub heater 20 can be almost equalized.

Figure 13:
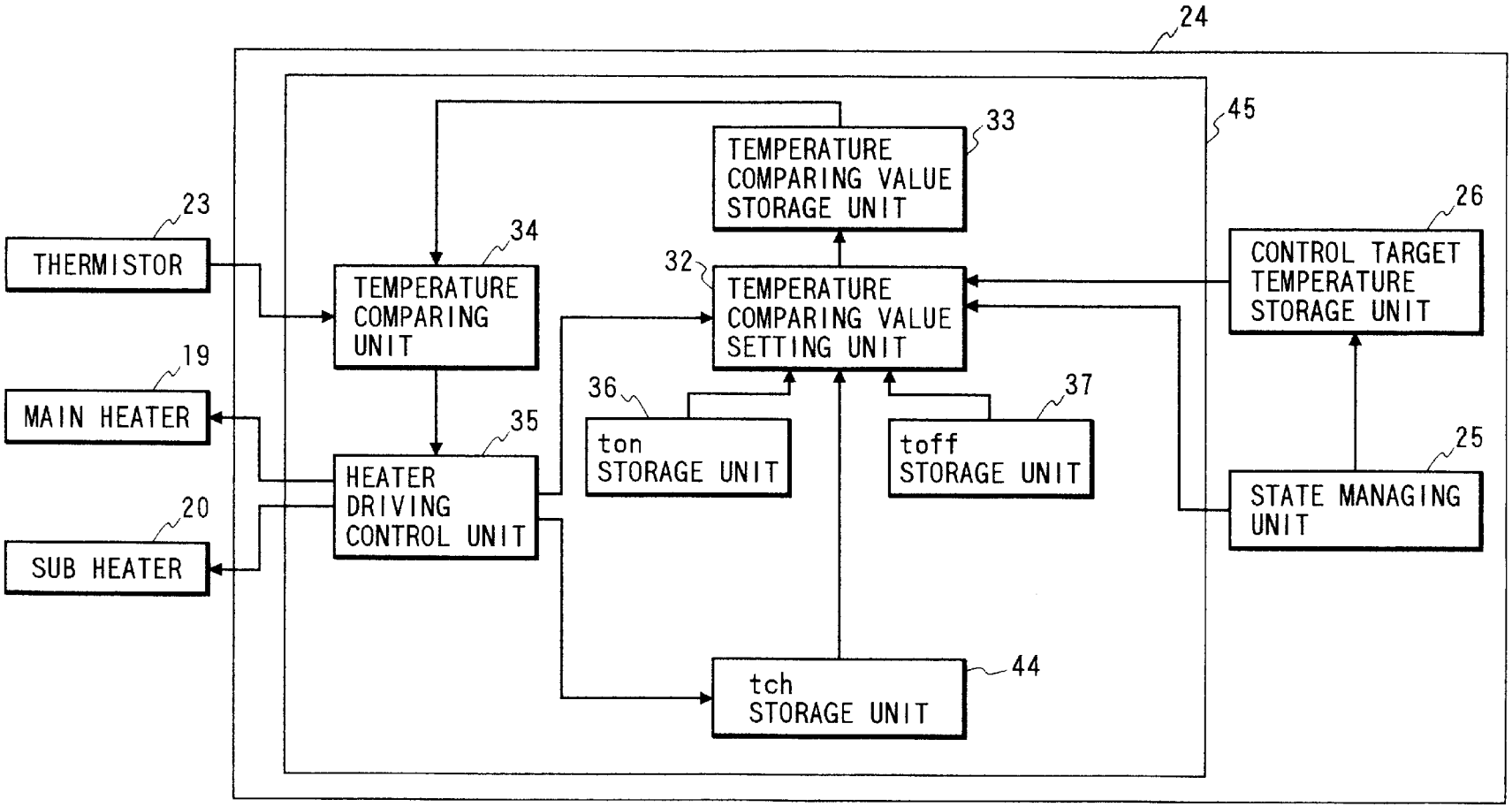
FIG. 13 is a block constructional diagram showing the third embodiment of the invention.

FIG. 13 is a block constructional diagram showing the third embodiment. In the third embodiment, a tch storage unit 44 in which a sub heater heating stop temperature tch has been stored is used in place of the Tsoff storage unit 38, time comparing value setting unit 39, time comparing value storage unit 40, time comparing unit 42, and timer 41 in the second embodiment. When the heater driving control unit 35 starts to drive the sub heater 20, the temperature comparing value setting unit 34 stores the sub heater heating stop temperature tch into the temperature comparing value storage unit 33. Thus, the heater driving control unit 35 switches the heater to drive from the sub heater 20 to the main heater 19 when the detection temperature tth reaches the sub heater heating stop temperature tch.

Figure 14:
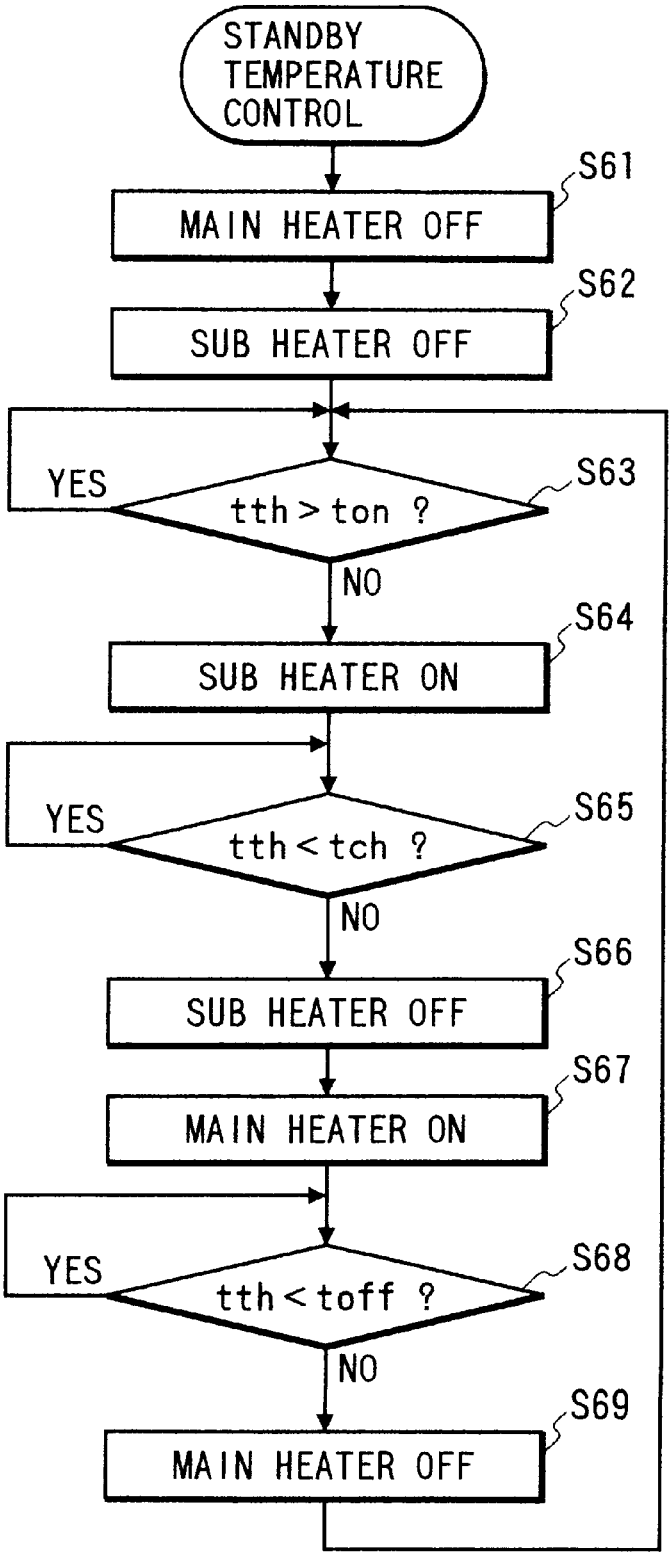
FIG. 14 is a flowchart showing a control procedure for a standby temperature adjustment control according to the third embodiment.

FIG. 14 is a flowchart showing a control procedure in the standby mode of a fixing heater control unit 45 according to the third embodiment.

First in step S61, the main heater 19 is turned off. In step S62, the sub heater 20 is turned off. In step S63, a check is made to see if the detection temperature tth of the thermistor 23 is higher than the heater heating start temperature ton. If YES, the apparatus waits until the detection temperature tth is equal to or lower than the heater heating start temperature ton. When the detection temperature tth is equal to or lower than the heater heating start temperature ton in step S63, the sub heater 20 is turned on in step S64. In step S65, a check is made to see if the detection temperature tth is lower than the sub heater heating stop temperature tch. If YES, the apparatus waits until the detection temperature tth reaches the sub heater heating stop temperature tch. When the detection temperature tth reaches the sub heater heating stop temperature tch, step S66 follows and the sub heater 20 is turned off. In step S67, the main heater 19 is turned on. In step S68, a check is made to see if the detection temperature tth is lower than the heater heating stop temperature toff stored in the toff storage unit 37. If YES, the apparatus waits until the detection temperature tth reaches the heater heating stop temperature toff. When the detection temperature tth reaches the heater heating stop temperature toff, the processing routine is returned to step S63 and the above processes are repeated.

An effect similar to that in the second embodiment can be also obtained by managing the switching between the sub heater 20 and main heater 19 on the basis of the detection temperature value in place of managing it by the time.

Figure 15:
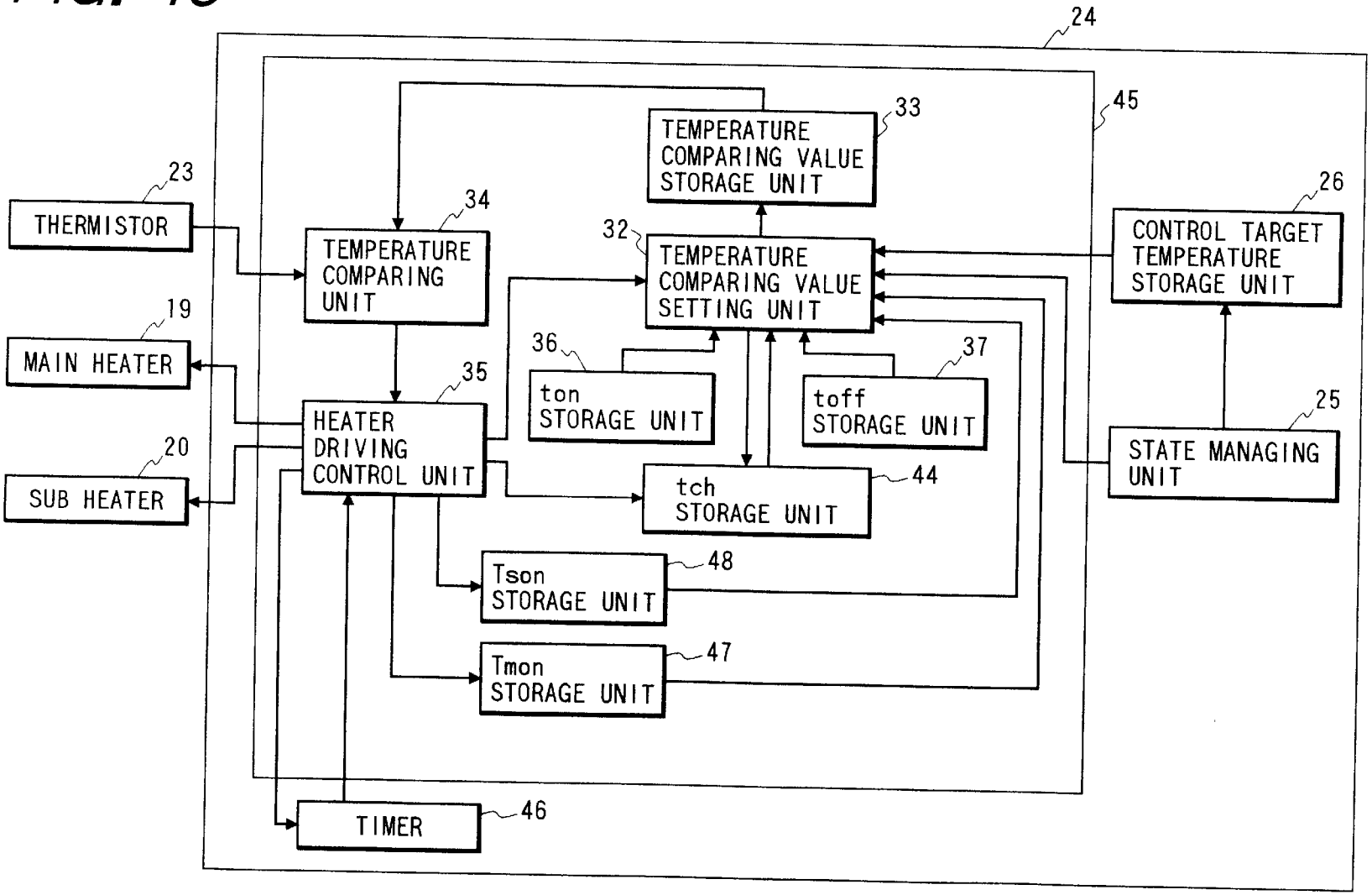
FIG. 15 is a block constructional diagram showing the fourth embodiment of the invention.

FIG. 15 is a block constructional diagram showing the fourth embodiment. In addition to the construction of the third embodiment (FIG. 13), fixing heater control unit 45 has: a timer 46 for measuring the heater heating times of the main heater 19 and sub heater 20; a Tmon storage unit 47 for storing a heating time Tmon of the main heater 19; and a Tson storage unit 48 for storing a heating time Tson of the sub heater 20. The heater driving control unit 35 starts the timer 46 by both of the turn-on of the sub heater 20 and the turn-on of the main heater 19. When the heating operation of each heater is stopped, the heater heating times Tmon and Tson are stored into the heater heating time storage units 47 and 48. The temperature comparing value setting unit 32 compares the heating time by the sub heater 20 and the heating time by the main heater 19 and adjusts the temperature values which are stored into the temperature comparing value storage unit 33 so as to almost equalize both of the heating times.

Figure 16:
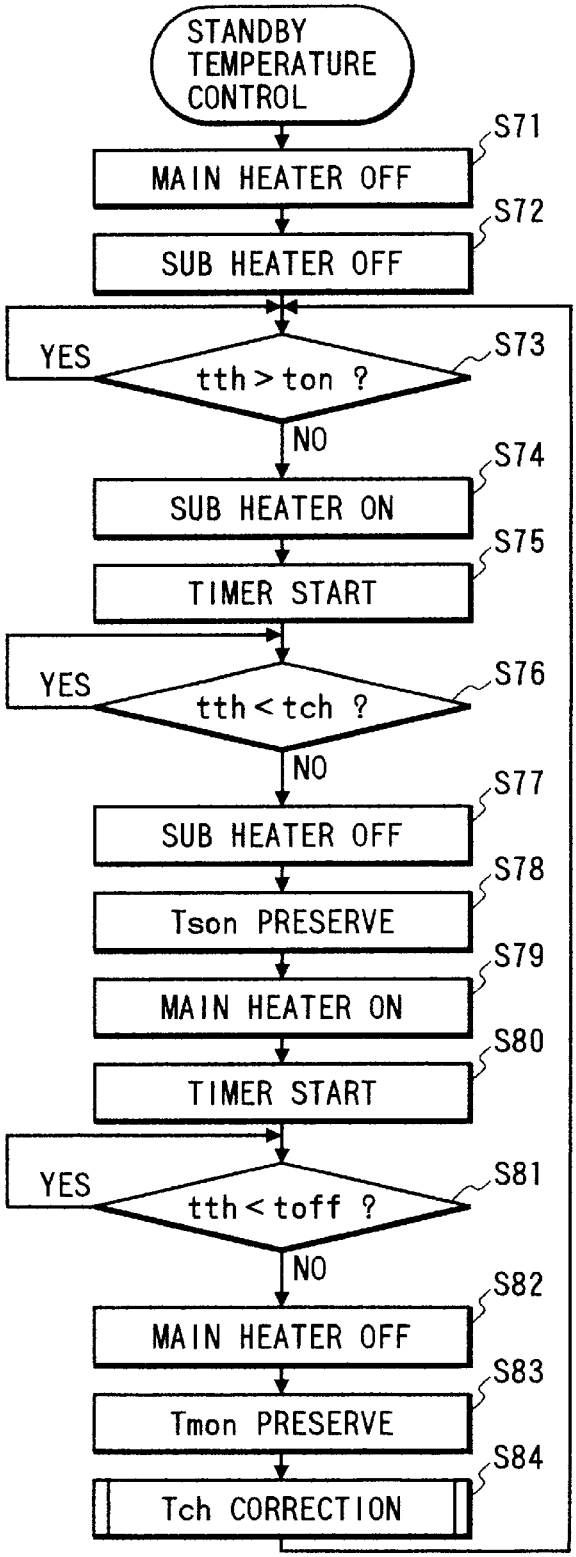
FIG. 16 is a flowchart showing a control procedure for a standby temperature adjustment control according to the fourth embodiment.

FIG. 16 is a flowchart showing a control procedure in the standby mode of the fixing heater control unit 45 according to the fourth embodiment.

First in step S71, the main heater 19 is turned off. In step S72, the sub heater 20 is turned off. In step S73, a check is made to see if the detection temperature tth of the thermistor 23 is higher than the heater heating start temperature ton. If YES, the apparatus waits until the detection temperature tth is equal to or lower than the heater heating start temperature ton. In step S73, when the detection temperature tth is equal to or lower than the heater heating start temperature ton, the sub heater 20 is turned on in step S74. In step S75, the timer 46 is started, thereby starting the counting operation. In step S76, a check is made to see if the detection temperature tth is lower than the sub heater heating stop temperature tch. If YES, the apparatus waits until the detection temperature tth reaches the sub heater heating stop temperature tch. When the detection temperature tth reaches the sub heater heating stop temperature tch, step S77 follows and the sub heater 20 is turned off. In step S28, the sub heater heating time Tson counted by the timer 46 is preserved in the Tson storage unit 48.

In step S79, the main heater 19 is turned on. In step S80, the timer 46 is started. A check is made to see if the detection temperature tth is lower than the heater heating stop temperature toff stored in the toff storage unit 37. If YES, the apparatus waits until the detection temperature tth reaches the heater heating stop temperature toff. When the detection temperature tth reaches the heater heating stop temperature toff, step S82 follows and the main heater 19 is turned off. In step S83, the main heater heating time Tmon counted by the timer 46 is preserved in the Tmon storage unit 47. In step S84, the sub heater heating stop temperature tch is corrected. The processing routine is returned to step S73.

Figure 17:
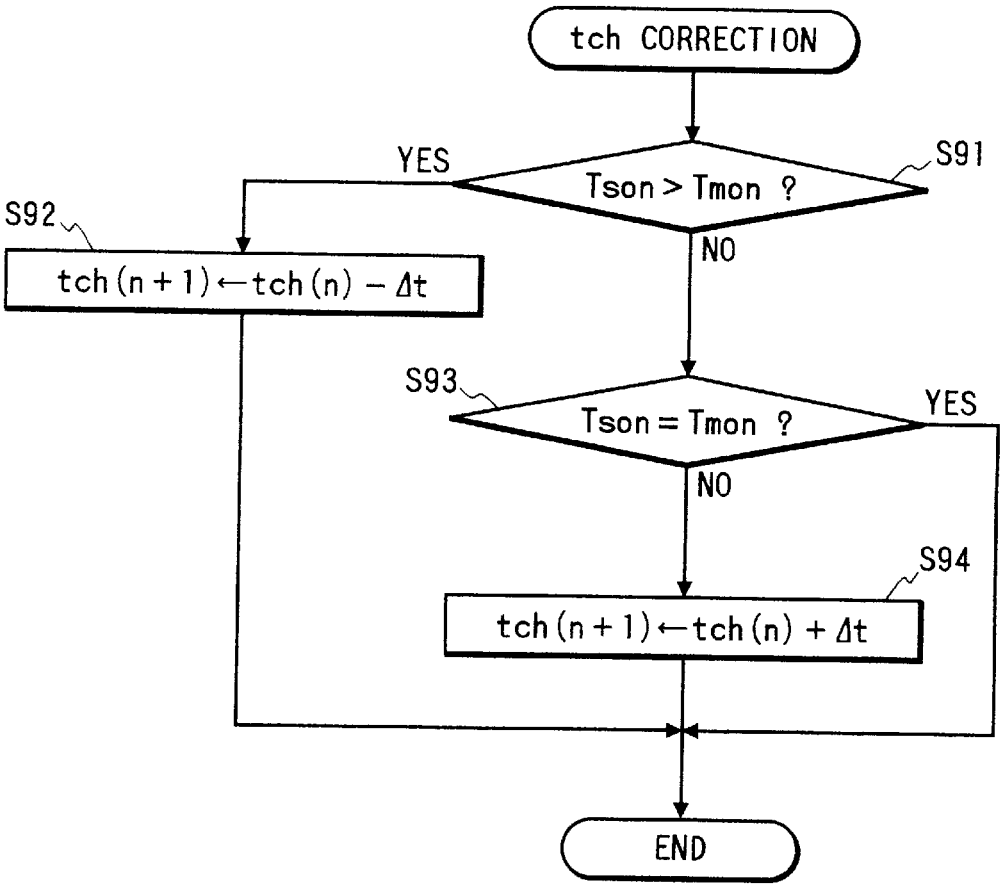
FIG. 17 is a flowchart showing a control procedure for a tch correction according to the fourth embodiment.

FIG. 17 is a flowchart showing a control procedure for the tch correction which is executed in step S73.

In step S91, a check is made to see if the sub heater heating time Tson is larger than the main heater heating time Tmon. If YES, step S92 follows and the sub heater heating stop temperature tch is reduced by only a predetermined micro temperature Δt. If NO in step S91, a check is made to see if the sub heater heating time Tson is equal to the main heater heating time Tmon. If YES, the processing routine is finished as it is. If NO, namely, when the sub heater heating time Tson is smaller than the main heater heating time, the sub heater heating stop temperature tch is increased by only the predetermined micro temperature Δt.

Figure 18:
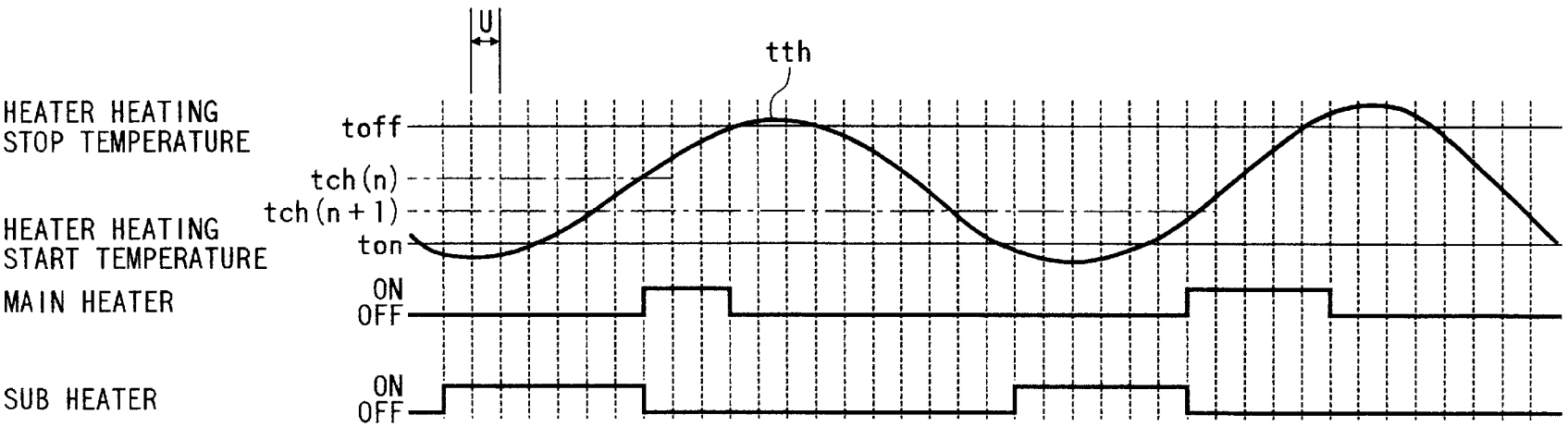
FIG. 18 is a time chart showing a temperature control in a standby mode according to the fourth embodiment.

FIG. 18 is a time chart showing the temperature control in the standby mode in the fourth embodiment.

When the detection temperature tth of the thermistor 23 reaches the heater heating start temperature ton, the sub heater 20 is turned on until the temperature reaches the sub heater heating stop temperature tch stored in the tch storage unit 44. When the detection temperature tth reaches the sub heater heating stop temperature tch, the sub heater 20 is turned off and the main heater 19 is turned on. When the detection temperature tth reaches the heater heating stop temperature toff, the main heater 19 is turned off. The heating stop temperature tch is corrected in accordance with the flowchart of FIG. 17. The corrected temperature is reflected to the heating stop temperature tch of the sub heater 20 at the next time, thereby performing the temperature control of the fixing roller 21.

As mentioned above, even by managing the heating stop temperature of the sub heater 20, the heating times of the main heater 19 and sub heater 20 can be adjusted so as to be almost equal.

The present invention is not limited to the foregoing embodiments but many modifications and variations are possible within the spirit and scope of the appended claims of the invention.

What is claimed is:

1. A fixing unit control apparatus of a recording apparatus, comprising:

a fixing unit having a first heater and a second heater;

temperature detecting means for detecting a temperature of said fixing unit;

storing means in which a heating start temperature and a heating stop temperature of said first heater and a heating start temperature and a heating stop temperature of said second heater have been stored;

comparing means for comparing the temperature detected by said temperature detecting means, with said heating start temperature of said first heater, said heating stop temperature of said first heater, said heating start temperature of said second heater, and said heating stop temperature of said second heater, respectively; and controlling means for alternately driving said first heater and said second heater, so as to drive said second heater if the detected temperature becomes lower than said heating start temperature of said second heater, then stop the driving of said second heater if the detected temperature becomes higher than said heating stop temperature of said second heater, then drive said first heater if the detected temperature becomes lower than said heating start temperature of said first heater, and then stop the driving of said first heater if the detected temperature becomes higher than said heating stop temperature of said first heater.

2. An apparatus according to claim 1, wherein said control means alternately drives said first and second heaters in a standby mode in which the image formation by said recording apparatus is not performed.

3. An apparatus according to claim 2, wherein said heating start temperature of said first heater is set to be higher than said heating start temperature of said second heater.

4. An apparatus according to claim 1, wherein a luminous intensity distribution of said first heater is different from a luminous intensity distribution of said second heater.

5. An apparatus according to claim 4, wherein said luminous intensity distribution of said first heater has peaks at positions near both ends of said fixing unit and said luminous intensity distribution of said second heater has a peak at a center of said fixing unit.

6. A fixing unit control apparatus of a recording apparatus, comprising:

a fixing unit having a first heater and a second heater;

temperature detecting means for detecting a temperature of said fixing unit;

first storing means in which a heating start temperature and a heating stop temperature which are common to said first and second heaters have been stored;

second storing means in which a time to heat said first heater has been stored;

measuring means for measuring the heating time of said first heater; and control means for alternately driving said first and second heaters by comparing the temperature detected by said temperature detecting means with each of the temperatures stored in said first storing means and by comparing the time measured by said measuring means with the time stored in said second storing means.

7. An apparatus according to claim 6, wherein when the temperature detected by said temperature detecting means reaches the heating start temperature stored in said first storing means, said control means starts the driving of said first heater, when the time measured by said measuring means reaches the time stored in said second storing means, said control means stops the driving of said first heater and starts the driving of said second heater, and when the temperature detected by said temperature detecting means reaches the heating stop temperature stored in said first storing means, said control means stops the driving of said second heater.

8. An apparatus according to claim 6, wherein said control means alternately drives said first and second heaters in a standby mode in which the image formation by said recording apparatus is not performed.

9. An apparatus according to claim 6, wherein a luminous intensity distribution of said first heater is different from a luminous intensity distribution of said second heater.

10. An apparatus according to claim 9, wherein said luminous intensity distribution of said first heater has peaks at positions near both ends of said fixing unit and said luminous intensity distribution of said second heater has a peak at a center of said fixing unit.

11. A fixing unit control apparatus of a recording apparatus, comprising:

a fixing unit having a first heater and a second heater;

temperature detecting means for detecting a temperature of said fixing unit;

first storing means in which a heating start temperature and a heating stop temperature which are common to said first and second heaters have been stored;

second storing means in which a time to heat said first heater has been stored;

measuring means for measuring the heating times of said first and second heaters;

control means for alternately driving said first and second heaters by comparing the temperature detected by said temperature detecting means with each of the temperatures stored in said first storing means and by comparing the heating time of said first heater measured by said measuring means with the time stored in said second storing means; and correcting means for correcting the time stored in said second storing means on the basis of the heating time of said second heater measured by said measuring means.

12. An apparatus according to claim 11, wherein said correcting means corrects each of the temperatures stored in said storing means so as to equalize the heating time of said first heater and the heating time of said second heater.

13. An apparatus according to claim 11, wherein when the temperature detected by said temperature detecting means reaches the heating start temperature stored in said first storing means, said control means starts the driving of said first heater, when the heating time of said first heater measured by said measuring means reaches the time stored in said second storing means, said control means stops the driving of said first heater and starts the driving of said second heater, and when the temperature detected by said temperature detecting means reaches the heating stop temperature stored in said first storing means, said control means stops the driving of said second heater.

14. An apparatus according to claim 11, wherein said correcting means compares the heating time of said second heater measured by said measuring means with the time stored in said second storing means and corrects the time stored in said second storing means on the basis of a comparison result.

15. An apparatus according to claim 11, wherein said control means alternately drives said first and second heaters in a standby mode in which the image formation by said recording apparatus is not performed.

16. An apparatus according to claim 11, wherein a luminous intensity distribution of said first heater is different from a luminous intensity distribution of said second heater.

17. An apparatus according to claim 16, wherein said luminous intensity distribution of said first heater has peaks at positions near both ends of said fixing unit and said luminous intensity distribution of said second heater has a peak at a center of said fixing unit.

18. A fixing unit control apparatus of a recording apparatus, comprising:

a fixing unit having a first heater and a second heater;

temperature detecting means for detecting a temperature of said fixing unit;

storing means in which heating start temperatures and heating stop temperatures of said first and second heaters have been stored, respectively;

measuring means for measuring heating times of said first heater and said second heater; and control means for alternately driving said first and second heaters by comparing the temperature detected by said temperature detecting means with each of the temperatures stored in said storing means; and correcting means for comparing the heating time of said first heater measured by said measuring means with the heating time of said second heater, thereby correcting each of the temperatures stored in said storing means on the basis of a comparison result.

19. An apparatus according to claim 18, wherein said correcting means corrects each of the temperatures stored in said storing means so as to equalize the heating time of said first heater and the heating time of said second heater.

20. An apparatus according to claim 18, wherein said control means alternately drives said first and second heaters in a standby mode in which the image formation by said recording apparatus is not performed.

21. An apparatus according to claim 18, wherein said heating start temperature of said first heater is set to be higher than said heating start temperature of said second heater.

22. An apparatus according to claim 18, wherein a luminous intensity distribution of said first heater is different from a luminous intensity distribution of said second heater.

23. An apparatus according to claim 22, wherein said luminous intensity distribution of said first heater has peaks at positions near both ends of said fixing unit and said luminous intensity distribution of said second heater has a peak at a center of said fixing unit.

24. A fixing unit control apparatus of a recording apparatus, comprising:

a fixing unit having a first heater and a second heater;

temperature detecting means for detecting a temperature of said fixing unit;

storing means in which heating start temperatures and heating stop temperatures of said first and second heaters have been stored, respectively; and control means for controlling so as to alternately drive said first and second heaters in a standby mode in which said recording apparatus doesn't perform a recording operation and to concurrently drive said first and second heaters in a printing mode in which said recording apparatus executes the recording operation.

25. An apparatus according to claim 24, wherein said control means alternately drives said first and second heaters by comparing the temperature detected by said temperature detecting means with each of the temperatures stored in said storing means in said standby mode.

26. An apparatus according to claim 24, wherein said control means alternately drives said first and second heaters in a standby mode in which the image formation by said recording apparatus is not performed.

* * * * *

UNITED STATES PATENT AND TRADEMARK OFFICE

CERTIFICATE OF CORRECTION

PATENT NO. : 6,008,829

DATED : December 28, 1999

INVENTOR(S): HIDEHIRO WAKAMIYA, ET AL.

It is certified that error appears in the above-identified patent and that said Letters Patent is hereby corrected as shown below:

COLUMN 1:
Line 36, "same-AC" should read --same AC--.
COLUMN 2:
Line 6, "Is" should read --is--; and
Line 17, "an" and "a" should be deleted.
COLUMN 3:
Line 36, "9e" should read --19e--; and
Line 48, "9b" should read --19b--.
COLUMN 6:
Line 16, "or' lower" should read --or lower--.
COLUMN 9:
Line 18, "made" should read --made to--.

Signed and Sealed this

Sixteenth Day of January, 2001

*Attest:*

*Attesting Officer*

Q. TODD DICKINSON

*Commissioner of Patents and Trademarks*